US005435717A

United States Patent [19]

Bohan, Jr. et al.

[11] Patent Number: 5,435,717

[45] Date of Patent: Jul. 25, 1995

[54] BURNER CONTROL SYSTEM WITH CONTINUOUS CHECK OF HOT SURFACE IGNITOR DURING RUN CYCLE

[75] Inventors: John E. Bohan, Jr., Edina; Vicki L. Perschbacher, Coon Rapids; Scott M. Peterson, Eden Prairie, all of Minn.

[73] Assignee: Honeywell Inc., Minneapolis, Minn.

[21] Appl. No.: 56,166

[22] Filed: Apr. 30, 1993

[51] Int. Cl.[6] ..... F23Q 9/08

[52] U.S. Cl. ..... 431/46; 431/66; 431/69; 431/74

[58] Field of Search ..... 431/46, 66, 69, 74

[56] References Cited

U.S. PATENT DOCUMENTS

| | | | |
|---|---|---|---|
| 2,407,438 | 9/1946 | Newman | 431/46 |
| 2,614,621 | 10/1952 | Main | 431/46 |
| 3,676,042 | 7/1972 | Osborne . | |
| 3,871,814 | 3/1975 | Das et al. . | |
| 4,190,414 | 2/1980 | Elmy . | |
| 4,306,853 | 12/1981 | Rippelmeyer . | |
| 4,323,342 | 4/1982 | Sommers, Jr. et al. . | |
| 4,405,299 | 9/1983 | Serber . | |
| 4,432,722 | 2/1984 | Bohan, Jr. et al. . | |
| 4,459,097 | 7/1984 | Riordan et al. . | |
| 4,560,343 | 12/1985 | Bohan, Jr. . | |
| 4,662,838 | 5/1987 | Riordan . | |
| 4,746,284 | 5/1988 | Geary . | |
| 4,755,132 | 7/1988 | Geary . | |
| 4,789,330 | 12/1988 | Ballard et al. . | |
| 4,806,095 | 2/1989 | Goldstein et al. . | |
| 4,850,852 | 7/1989 | Ballard . | |
| 4,891,004 | 1/1990 | Ballard et al. . | |
| 4,915,614 | 4/1990 | Geary | 431/46 |
| 4,963,088 | 10/1990 | Erdman . | |
| 5,020,988 | 6/1991 | Peterson . | |
| 5,035,607 | 7/1991 | Peterson . | |
| 5,074,780 | 12/1991 | Erdman . | |
| 5,076,780 | 12/1991 | Erdman . | |
| 5,133,656 | 7/1992 | Peterson | 431/66 |

OTHER PUBLICATIONS

Honeywell Inc. product information brochure, Form Number 68-0070-1 for S89 and S890 Hot Surface Ignition Modules (Rev. 9-89).

*Primary Examiner*—Carroll B. Dority

*Attorney, Agent, or Firm*—Charles L. Rubow

[57] ABSTRACT

A fuel valve and ignitor control system in which pull-in current for a fuel valve operating on rectified alternating current is supplied through a first normally open relay whose coil is connected in series with normally open contacts of a second relay and an intermittently operating hot surface ignitor. Normally closed contacts of the second relay are connected in series with the ignitor and the fuel valve through a holding resistor, whereby actuation of the second relay provides unrectified alternating current to the ignitor and actuates the first relay to provide pull-in current to the fuel valve, and whereby deactivation of the second relay provides holding current to the fuel valve through the ignitor.

15 Claims, 2 Drawing Sheets

BURNER CONTROL SYSTEM WITH CONTINUOUS CHECK OF HOT SURFACE IGNITOR DURING RUN CYCLE

BACKGROUND OF THE INVENTION

The present invention relates generally to a control apparatus for fluid fuel burners of the type having an intermittent pilot and a hot surface ignitor, and more particularly to an arrangement of such apparatus in which energization of a fuel valve is conditioned on flow of electric current through the ignitor.

For reasons set forth in detail in a number of prior references, including U.S. Pat. Nos. 5,020,988, 5,035,607 and 5,133,656, a gas burner system employing an intermittently operating pilot ignited by a hot surface ignitor has become a preferred burner system arrangement. One safety concern with such an arrangement is that fuel gas not be supplied to the burner if the ignitor is not operating properly. A variety of approaches have been taken to addressing this concern. For example, in the burner control system of U.S. Pat. No. 5,020,988, fuel valve energization is controlled by a circuit, including a sequencer which locks out energization to a pilot valve, and, in turn, prevents energization of a main valve where attempts to light a pilot burner have been unsuccessful. U.S. Pat. No. 5,035,607 discloses a burner control system in which ignitor voltage and/or current are monitored to indicate operating state of the ignitor, and used to prevent energization of the fuel valve in the event proper ignitor operation is not indicated.

In both of the previously described arrangements, safety is ensured by sensing a condition related to proper ignitor operation, and utilizing the sensed condition to control a fuel valve operator. Each of these arrangements utilizes a flame sensor for detecting presence of a pilot flame, which condition implies proper operation of the ignitor. Detection of a pilot flame also causes power to be cut to the ignitor to prolong ignitor life, and causes opening of a main fuel valve. The arrangement of U.S. Pat. No. 5,035,607 also implies proper operation of the ignitor from sensed voltage and current conditions at the ignitor, and does not allow fuel to be supplied to the pilot or main burners in the absence of predetermined voltage and/or current conditions, which provides additional safety.

A more direct and simple arrangement for preventing supply of fuel to a burner if the ignitor is not operating properly, is to connect the fuel valve solenoid and ignitor in series so that the same current energizes both the ignitor and fuel valve. Thus, any condition which interferes with adequate current through the ignitor, such as the ignitor burning open, also prevents operation of the fuel valve. Such a system is shown in U.S. Pat. No. 5,133,656. However, the arrangement disclosed in this patent is only suitable for a single fuel valve, and not to a dual fuel valve for use in a burner configuration including both pilot and main burners.

The applicants have devised a burner control system which incorporates a safety feature similar to that of U.S. Pat. No. 5,133,656 into a dual fuel valve system, thus providing simplicity and direct fuel valve safety control in an intermittent pilot type of fuel burner.

SUMMARY OF THE INVENTION

The invention is an ignitor and fuel valve control for intermittent pilot burner apparatus, in which a first solenoid operated fuel valve requires greater current for pull-in than for holding in an actuated state, the pull-in and holding currents being supplied through separate current paths, of which the pull-in current path does not include the ignitor and the holding current path includes the ignitor. The coil of a first relay and pair of normally open pair of contacts of a second relay are connected in series with the ignitor across power supply terminals. A normally open pair of contacts of the first relay is connected to permit full power supply voltage to be applied across the fuel valve solenoid to provide adequate pull-in current. A normally closed pair of contacts of the second relay is connected between the ignitor and the fuel valve solenoid to permit holding current to be supplied to the fuel valve solenoid through the ignitor. The holding current path may include an impedance element to maintain current through that path at a value between the pull-in and holding current values of the fuel valve solenoid. A second solenoid operated fuel valve connected to be supplied with current through a normally closed pair of contacts of the first relay may also be included. The second relay, as well as an electronic switch in the current path for the second fuel valve, may be controlled through a flame sensing and safe start check circuit in response to a call for burner operation.

DESCRIPTION OF THE PREFERRED EMBODIMENT

Figure 1:
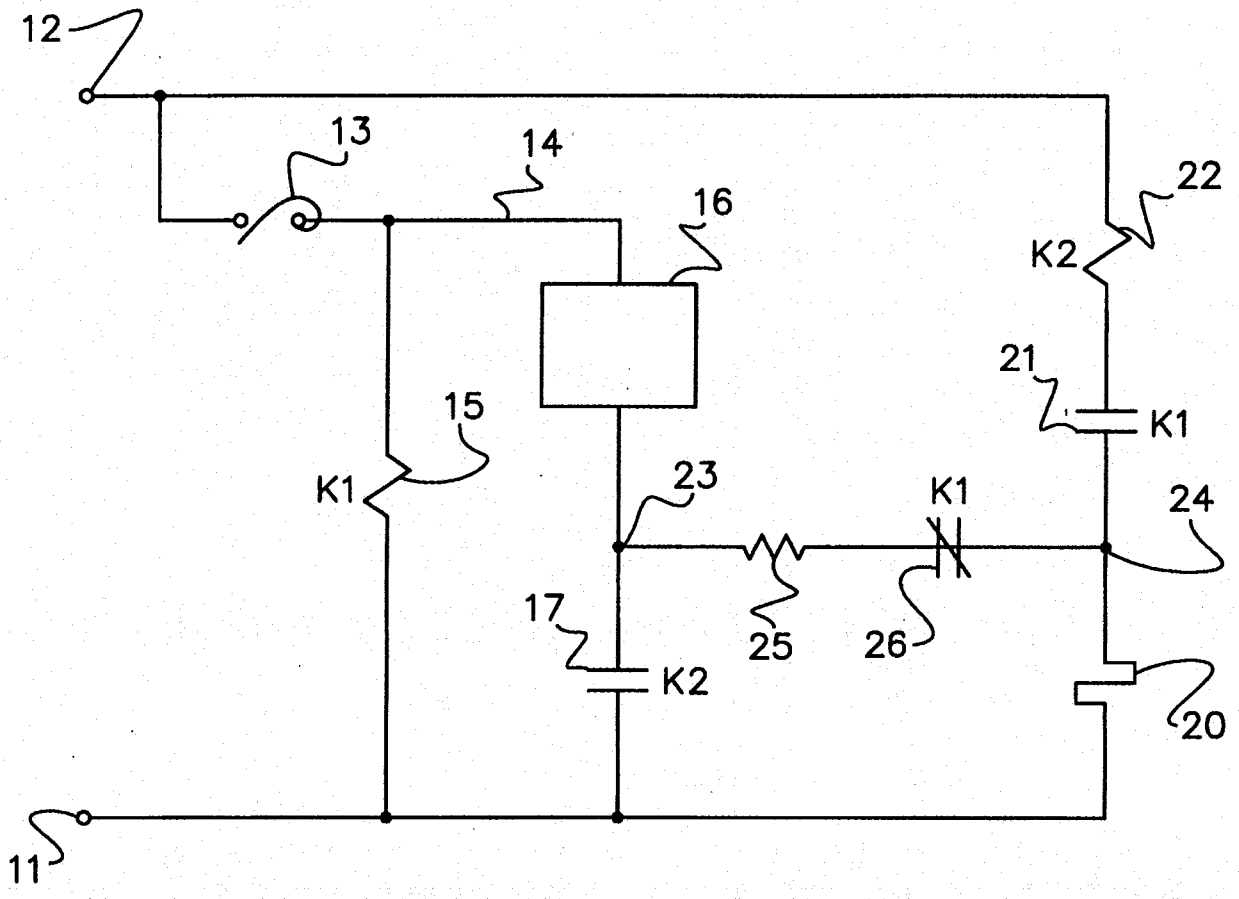
FIG. 1 is a simplified diagram of the applicants' control system, illustrating its principle operating concepts and functions.

In a simplified illustration of FIG. 1, reference numerals 11 and 12 identify power supply terminals for receiving alternating current at a predetermined voltage, typically 24 volts, and supplying the current to circuitry in the control system. Terminal 11 may be maintained at system ground potential.

Reference numeral 13 identifies a thermostatic switch which may be a temperature sensitive bimetallic device located in a space whose temperature is to be controlled. Switch 13 is open when there is no demand for heat in the space. Upon a call for heat, switch 13 closes to supply the voltage from terminal 12 through a control terminal to a conductor 14 downstream from the switch. A coil 15 of a first relay is connected between conductor 14 and terminal 11. Also connected in series between conductor 14 and terminal 11 is a solenoid operated fuel valve 16, shown in block diagram form, and a normally open pair of contacts 17 of a second relay. Valve 16 may be a conventional commercially available fuel valve, as further discussed in conjunction with FIG. 2. For purposes of the present invention, a significant characteristic of valve 16 is that the operating solenoid therein requires greater pull-in current for opening the fuel valve than holding current for maintaining the fuel valve in an open state.

Connected in series between power supply terminals 11 and 12 are a conventional commercially available hot surface ignitor 20, a normally open pair of contacts 21 of the first relay and a coil 22 of the second relay. As shown, fuel valve 16 and normally open contact pair 17 are connected at a first junction 23 which forms a fuel valve energization terminal, and ignitor 20 and normally open contact pair 21 are connected at a second junction 24 which forms an ignitor energization terminal. Connected in series between junctions 23 and 24 are an impedance element or resistor 25 and a normally closed pair of contacts 26 of the first relay. Resistor 25 is selected to have a value which, when thermostatic switch 13 and normally closed contact pair 26 are closed, maintains the current through the solenoid of valve 16 at a value between the pull-in and holding current values thereof.

In operation, upon a call for heat, switch 13 closes, thus energizing coil 15 of the first relay. This causes normally open contact pair 21 to close, thereby energizing ignitor 20 and coil 22 of the second relay, and opening normally closed contact pair 26. Energization of coil 22 causes normally open contact pair 17 to close, thereby supplying pull-in current to valve 16, which supplies fuel to a burner (not shown) proximate energized ignitor 20 which ignites the fuel.

Figure 2:
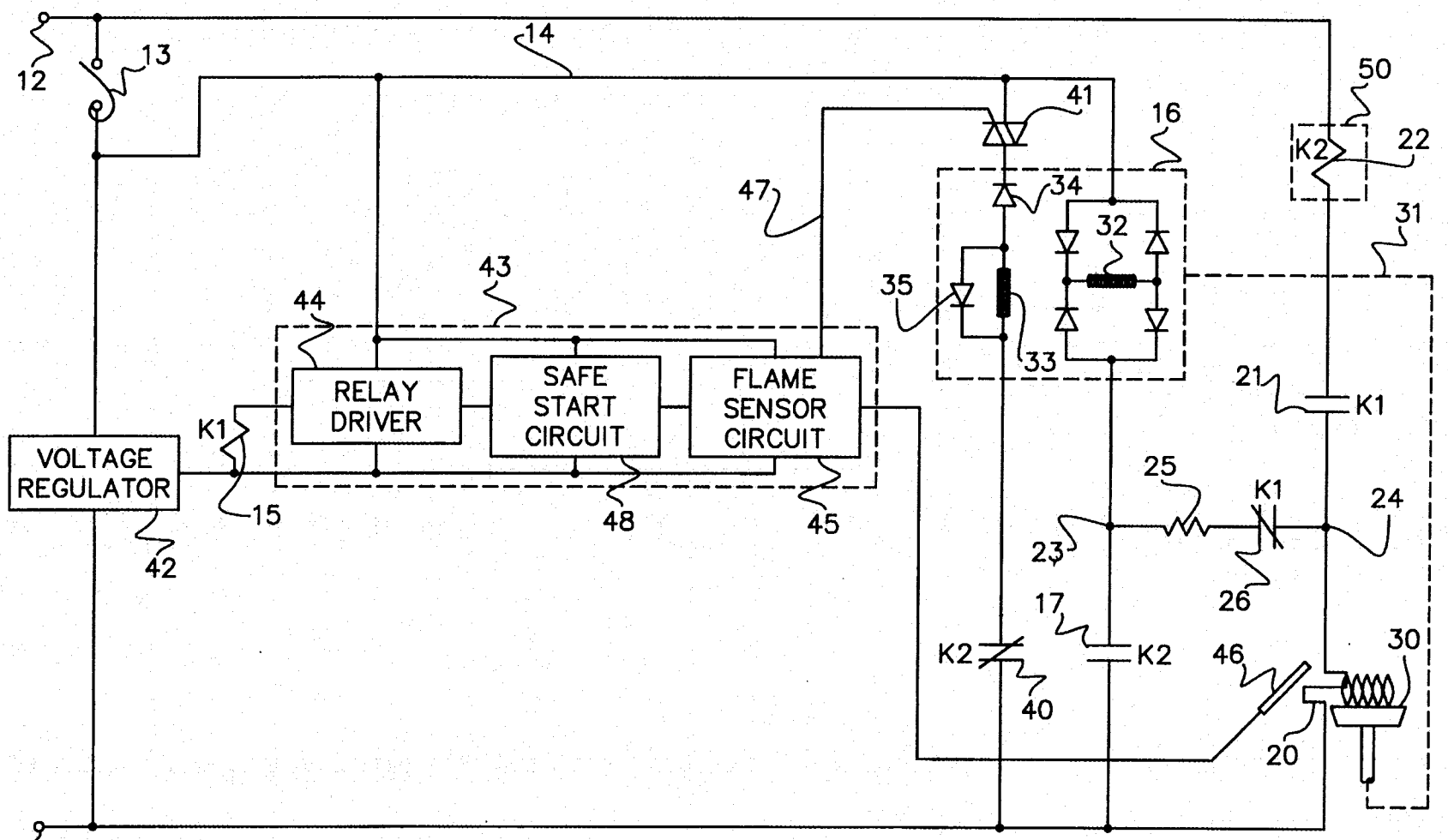
FIG. 2 is a more detailed illustration of the control system of FIG. 1, partially in block diagram form.

Flame sensor apparatus which detects flame at the burner, as further described in conjunction with FIG. 2, and circuitry associated therewith, then deenergizes the first relay, which causes contact pair 21 to open and contact pair 26 to close. This terminates the application of substantially full power supply voltage to ignitor 20, thereby rendering the ignitor incapable of normal operation, and deenergizes coil 22, thereby opening contact pair 17 which terminates application of full power supply voltage to valve 16. However, holding current for valve 16 is now supplied through a second current path including ignitor 20, contact pair 26 and resistor 25 to maintain valve 16 in an open state as long as thermostatic switch 13 is closed.

As is apparent from the foregoing description, ignitor 20 must be capable of conducting current in order for valve 16 to be energized. Any condition which precludes current flow through ignitor 20, such as the ignitor having burned open, prevents both pull-in and holding current from being supplied to valve 16. Pull-in current is prevented because electrical continuity of ignitor 20 is required for actuation of the second relay and closure of contact pair 17. Holding current is prevented because any hold-in current is supplied only through ignitor 20. Accordingly, the system of FIG. 1 provides a very simple and direct implementation for preventing opening of valve 16 if ignitor 20 is not capable of normal operation.

In the more detailed illustration of the applicants' ignitor and fuel valve control system shown in FIG. 2, the same reference numerals as in FIG. 1 are used to identify like elements. FIG. 2 also illustrates a conventional fuel burner assembly 30, which may include both pilot and main burners supplied with fuel as indicated by dashed line 31 from valve 16. Valve 16 is shown as dual fuel valve, of which a pilot valve is operated by a solenoid 32 and a main valve is operated by a solenoid 33. The arrangement of valve 16 is such that fuel to the pilot burner is supplied through the pilot valve alone, and fuel to the main burner is supplied from the pilot valve through the main valve.

Solenoid 32 is shown as connected in a full-wave diode bridge so as to be supplied with full-wave rectified alternating current, which is a conventional implementation for a solenoid operator requiring greater pull-in current than holding current. Solenoid 33 is connected to be supplied with half-wave rectified alternating current through a diode 34. A diode 35 connected across coil 33 provides a current circulation path through the coil during the portions of a current cycle when diode 34 is reverse biased. Coil 33 and diode 34 are connected in series with a normally closed pair of contacts 40 of the second relay and a bidirectional electronic switch or triac 41, between terminal 11 and conductor 14.

A relatively constant DC voltage is produced by voltage regulation circuitry 42 connected between terminal 11 and conductor 14, and is supplied to other portions of the circuit requiring a DC supply voltage. Reference numeral 43 identifies a commercially available hybrid circuit for performing certain conventional sensing, sequencing and control functions. Specifically, circuit 43 includes a relay driver 44 which supplies suitable energization to coil 15 of the first relay. Circuit 43 also includes a flame sensor circuit 45 to which is connected a flame probe 46 positioned relative to burner assembly 30 so as to detect flame produced particularly by the pilot burner, and which, under predetermined conditions, supplies an electrical control signal to electronic switch 41 over a conductor 47.

Hybrid circuit 43 also includes safe start circuitry 48 which performs certain logic and sequencing functions. In particular, at the beginning of an operating cycle, circuit 48 checks to ensure that no flame is detected or indicated by flame sensor circuit 45 before activating relay driver 44.

Coil 22 of the second relay is shown enclosed in a dashed line box 50 which may contain supplemental circuit components to carry a portion of the current required for full operation of ignitor 20, thereby avoiding a requirement that all of the current be carried through coil 22. Although relays with AC coils capable of carrying the required current are commercially available, additional components, as indicated by box 50, can be provided to permit the use of a less expensive relay.

The operation of the system of FIG. 2 is similar to that described in conjunction with FIG. 1. In particular, upon a call for heat in the space in which thermostatic switch 13 is located, the switch closes, thereby applying voltage to conductor 14. The voltage on conductor 14 is supplied to fuel valve solenoid coil 32 and its surrounding diode bridge, triac 41 and hybrid circuit 43. As previously described, if safe start circuit 48 determines that conditions are satisfactory for burner start up, it activates relay driver 44 which energizes relay coil 15 and closes normally opened contact pair 21 to energize ignitor 20 and relay coil 22. Energization of relay coil 22 closes contact pair 17 to supply pull-in current to pilot valve solenoid 32, thereby causing fuel to be supplied to the pilot burner of burner assembly 30. The pilot burner is ignited by energized ignitor 20, and the pilot flame is detected by flame probe 46, which causes flame sensor circuit 45, in conjunction with safe start circuit 48, to supply a control signal to triac 41 through which energization current may be supplied to main valve solenoid 33.

After sensing a pilot flame, flame sensor circuit 45, in conjunction with safe start circuit 48, deactivates relay driver 44, thereby opening contact pair 21. This removes the full power supply voltage from ignitor 20 and de-energizes relay coil 22, thereby opening contact pair 17 through which pull-in current was supplied to pilot valve solenoid 32 and closing contact pair 40. De-energization of relay coil 15 also causes contact pair 26 to close, thereby maintaining holding current to pilot valve solenoid 32 through ignitor 20, resistor 25 and contact pair 26, as long as thermostatic switch 13 is closed.

As previously described in conjunction with FIG. 1, both pull-in and holding current to pilot valve solenoid 32 depend on electrical continuity through ignitor 20. In particular, current for energizing relay coil 22, whose related normally open contacts supply pull-in current to solenoid coil 32, must pass through ignitor 20. In addition, holding current through solenoid coil 32 must pass through ignitor 20. Thus, electrical continuity of ignitor 20 is continuously checked during the burner run cycle, and no fuel can be supplied to the burner if the ignitor is not in operating condition.

In accordance with the foregoing description, the applicants have provided a unique, simple and direct ignitor and fuel valve control system implementation which very effectively ensures safe burner operation. Although a particular embodiment has been shown and described in illustrative purposes, other implementations which do not depart from the applicants' teachings will be apparent to those of ordinary skill in the relevant arts. It is intended that protection not be limited to a disclosed embodiment, but only by the terms of the following claims.

The embodiments of the invention in which an exclusive property or right is claimed are defined as follows:

1. A fuel valve control system comprising:

a solenoid operated fuel valve for supplying fuel to a burner, said valve including a first solenoid coil having first and second terminals and requiring at least a first predetermined electric current between the first and second terminals for actuation, and at least a second predetermined current between the first and second terminals smaller than the first predetermined current for holding in an actuated state;

power supply terminal means having a first terminal and second terminal means for receiving electric current and conducting the current through an electrical load connected between the first terminal and the second terminal means;

a control terminal adapted for connection to the first terminal of said power supply terminal means through a temperature sensitive switch;

a first electrical relay having a normally open pair of contacts and a coil which, when supplied with electric current, causes the normally open pair of contacts thereof to close, the normally open pair of contacts being connected between the first terminal of said fuel valve and the second terminal means of said power supply terminal means;

an ignitor energization terminal, said ignitor energization terminal and the second terminal means of said power supply terminal means being adapted to supply electric current to a resistive ignitor connected therebetween;

a second electrical relay having a normally open pair of contacts, a normally closed pair of contacts and a coil which, when supplied with electric current, causes the normally open pair of contacts thereof to close and the normally closed pair of contacts thereof to open;

first electrical connecting means connecting the coil of said second electrical relay between said control terminal and the second terminal means of said power supply terminal means;

second electrical connecting means connecting said control terminal to the second terminal of said fuel valve and the coil of said second electrical relay;

third electrical connecting means connecting the coil of said first electrical relay and the normally open pair of contacts of said second electrical relay in series between the first terminal of said power supply terminal means and said ignitor energization terminal; and fourth electrical connecting means connecting the normally closed pair of contacts of said second electrical relay between the first terminal of said fuel valve and said ignitor energization terminal.

2. The control system of claim 1 wherein said electric connecting means includes an impedance element for limiting electric current through the first solenoid coil to a value less than the first predetermined current and greater than the second predetermined current.

3. The control system of claim 2 wherein:

said solenoid operated fuel valve is a dual fuel valve including a first valve operated by the first solenoid coil and a second valve operated by a second solenoid coil having third and fourth terminals, the first and second valves arranged so that the second valve supplies fuel from the first valve to the burner;

said first electrical relay has a normally closed pair of contacts which are caused to open when electric current is supplied to the coil of said first electrical relay; and controlled switch means is provided, said controlled switch means being operable to pass electric current in response to an electrical control signal, said controlled switch means, the second solenoid coil of said fuel valve and the normally closed pair of contacts of said first electrical relay being connected in series between said control terminal and the second terminal means of said power supply terminal means, said controlled switch means further being connected to receive an electrical control signal from said first electrical connecting means.

4. The control system of claim 3 wherein said first electrical connecting means is responsive to presence of flame at the burner, is operable to supply electric current to the coil of said second electrical relay only if no flame is detected at the burner, and is operable to supply an electrical control signal to said controlled switch means only if flame is detected at the burner.

5. In fuel valve apparatus of the type including a first solenoid operated fuel valve for supplying fuel to a burner which is ignited by an intermittently operating hot surface ignitor adapted for operation on alternating current at a predetermined voltage, the first solenoid operated fuel valve requiring greater current for pull-in than for holding in an actuated state, the actuation and holding currents being supplied through separate current paths of which the pull-in current path does not include the ignitor and the holding current path includes the ignitor, the improvement which comprises:

first and second power supply terminals for receiving alternating electric current at the predetermined voltage, a control terminal for selectively receiving electric energization from said second power supply terminal through a temperature sensitive switch, and an ignitor energization terminal;

a first electrical relay having a normally open pair of contacts and a coil which, when supplied with electric current, causes the normally open pair of contacts to close, the normally open pair of contacts of said first electrical relay being connected between said first power supply terminal and a first junction;

a second electrical relay having a normally open pair of contacts, a normally closed pair of contacts and a coil which, when supplied with electric current, causes the normally open pair of contacts to close and the normally closed pair of contacts to open, the coil of said first electrical relay and the normally open pair of contacts of said second electrical relay being connected in series between said second power supply terminal and said ignitor energization terminal;

first electrical connecting means for connecting a hot surface ignitor between said first power supply terminal and said ignitor energization terminal to supply electric current to the ignitor;

second electrical connecting means for connecting the first solenoid operated fuel valve between said control terminal and the first junction;

third electrical means for connecting the normally closed pair of contacts of said second electrical relay between said ignitor energization terminal and the first junction; and control signal means responsive to electrical energization at said control terminal connecting the coil of said second electrical relay between said first power supply terminal and said control terminal.

6. The fuel valve apparatus of claim 5 wherein said third electrical connecting means includes an impedance element for limiting the current through the first solenoid operated fuel valve to less than the pull-in current.

7. The fuel valve apparatus of claim 6 further including:

a second solenoid operated fuel valve for supplying fuel from said first solenoid operated fuel valve to the burner;

a normally closed pair of contacts of said first electrical relay; controlled switch means responsive to a control signal from said control signal means; and fourth electrical connecting means for connecting the second solenoid operated fuel valve, the normally closed pair of contacts of said first electrical relay and the controlled switch means in series between said first power supply terminal and said control terminal.

8. The fuel valve apparatus of claim 7 wherein said control signal means is adapted to respond to flame at the burner by de-energizing the coil of said second electrical relay and supplying a signal to the controlled switch means which puts said controlled switch means into a state to conduct electric current to said second solenoid operated fuel valve.

9. A burner control system comprising:

a fuel burner for supplying heat to a space;

fuel valve means for supplying fuel to said burner, said fuel valve means including a first solenoid actuated valve which requires at least a first predetermined electric current for actuation, and at least a second predetermined current smaller than the first predetermined current for holding in an actuated state;

first and second power supply conductors for supplying alternating electric current at a predetermined voltage between the conductors;

thermostatic switch means connected to said first power supply conductor for supplying alternating current through an output terminal thereof when the temperature in the space is below a preset temperature;

a first electrical relay having a normally open pair of contacts and a coil, which, when supplied with electric current, causes the normally open pair of contacts to close;

first electrical connecting means connecting the normally open pair of contacts of said first electrical relay and the solenoid of the first solenoid actuated valve in series between the output terminal of said thermostatic switch means and said second power supply conductor, the normally open pair of contacts being connected to the solenoid at a first junction;

a resistive ignitor positioned relative to said burner so as to ignite fuel issuing therefrom, and operable to ignite the fuel when supplied with at least a third predetermined electric current greater than the current required to hold the first solenoid actuated valve in its actuated state;

a second electrical relay having a normally open pair of contacts and a normally closed pair of contacts, said second electrical relay being functionally connected to said thermostatic switch means so as to be actuated only when the temperature in the space is below the preset temperature;

second electrical connecting means connecting the coil of said first electrical relay, the normally open pair of contacts of said second electrical relay and said resistive ignitor in series between said first and second power supply conductors, the coil of said first electrical relay being functionally connected between said first power supply conductor and a second junction, said resistive ignitor being functionally connected between said second power supply conductor and the second junction; and third electrical connecting means connecting the normally closed pair of contacts of said second electrical relay between the first and second junctions.

10. The burner control system of claim 9 wherein said third electrical connecting means includes an impedance element for limiting electric current through the first solenoid actuated valve and said resistive ignitor to a value less than the first predetermined current and greater than the second predetermined current.

11. The burner control system of claim 10 including flame responsive means which forms the functional connection between said second electrical relay and said thermostatic switch means, said flame responsive means being adapted to de-actuate said second electrical relay upon detecting flame at said fuel burner.

12. The burner control system of claim 11 wherein:

said first electrical relay includes a normally closed pair of contacts;

said fuel valve means includes a second solenoid actuated valve for supplying fuel from the first solenoid actuated valve to said fuel burner when supplied with electrical energization;

controllable switch means operable to pass electric Current in response to an electrical control signal;

fourth electrical connecting means connecting the second solenoid actuated valve, the normally closed pair of contacts of said first electrical relay and said controllable switch means in series between the output terminal of said thermostatic switch means and said second power supply conductor; and control signal means for supplying an electrical control signal from said flame responsive means to said controllable switch means when said flame responsive means detects flame at said fuel burner.

13. The burner control system of claim 12 wherein:

said flame responsive means is connected to receive a signal from said thermostatic switch means when the temperature in the space is below the preset temperature; and said flame responsive means is adapted to verify absence of flame at said fuel burner before causing actuation of said second electrical relay.

14. A fuel valve and hot surface ignitor control circuit for a solenoid operated fuel valve for supplying fuel to a burner adapted for ignition by an intermittently operating hot surface ignitor, the fuel valve including a solenoid coil which requires greater current for pull-in than for holding in an actuated state, the hot surface ignitor being adapted for operation on alternating current at a predetermined voltage, the control circuit comprising;

first and second power supply terminals, a control terminal, a fuel valve energization terminal, and an ignitor energization terminal;

a first electrical relay having a normally open pair of contacts and a coil which, when supplied with electric current, is adapted to cause the normally open pair of contacts to close, the normally open pair of contacts being connected between said first power supply terminal and said valve energization terminal;

a second electrical relay having a normally open pair of contacts, a normally closed pair of contacts and a coil which, when supplied with electric current, is adapted to cause the normally open pair of contacts to close and the normally closed pair of contacts to open;

first electrical connecting means connecting the coil of said first electrical relay and the normally open pair of contacts of said second electrical relay in series between said second power supply terminal and said ignitor energization terminal;

second electrical connecting means connecting the normally closed pair of contacts of said second relay between said valve energization terminal and said ignitor energization terminal; and third electrical connecting means connecting the coil of said second electrical relay between said first power supply terminal and said control terminal.

15. The control circuit of claims 14 wherein said second electrical connecting means includes an impedance element for limiting electric current through the solenoid coil of a fuel valve connected to the valve energization terminal and an ignitor connected to the ignitor energization terminal to less than the pull-in current of the solenoid coil.

* * * * *

UNITED STATES PATENT AND TRADEMARK OFFICE

CERTIFICATE OF CORRECTION

PATENT NO. : 5,435,717

DATED : July 25, 1995

INVENTOR(S) : Bohan et al.

It is certified that error appears in the above-indentified patent and that said Letters Patent is hereby corrected as shown below:

Column 6, line 14, insert --fourth-- between "said" and "electric".

Signed and Sealed this

Fourth Day of June, 1996

*Attest:*

*Attesting Officer*

BRUCE LEHMAN

*Commissioner of Patents and Trademarks*